United States Patent [19]

Kirby et al.

[11] Patent Number: 4,865,579

[45] Date of Patent: Sep. 12, 1989

[54] NAPKIN FOLDER

[76] Inventors: James Kirby, 33557 Agua Dulce Canyon Rd., Agua Dulce, Calif. 91351; George Enos, 27166 Seco Cyn Rd., Saugus, Calif. 91350

[21] Appl. No.: 195,789

[22] Filed: May 19, 1988

[51] Int. Cl.[4] ..... B31B 1/26

[52] U.S. Cl. ..... 493/458; 493/405; 493/937; 493/960

[58] Field of Search ..... 493/395, 405, 408, 409, 493/451, 458, 460, 960, 250, 937

[56] References Cited

U.S. PATENT DOCUMENTS

| | | | |
|---|---|---|---|
| 797,864 | 8/1905 | Naylor . | |
| 1,806,125 | 5/1931 | Spohn . | |
| 1,809,000 | 6/1931 | Stealy . | |
| 3,658,818 | 8/1972 | Burger et al. | 493/418 |
| 4,338,086 | 7/1982 | Heater | 493/458 |
| 4,421,500 | 12/1983 | Smith . | |
| 4,636,192 | 1/1987 | Vogtlander et al. | 493/405 |
| 4,648,861 | 3/1987 | Pierce | 493/418 |

FOREIGN PATENT DOCUMENTS

| | | | |
|---|---|---|---|
| 106031 | 12/1938 | Australia | 493/458 |

*Primary Examiner*—Frederick R. Schmidt
*Assistant Examiner*—Robert Showalter
*Attorney, Agent, or Firm*—Amster, Rothstein & Ebenstein

[57] ABSTRACT

A sheet folding apparatus comprises a substantially planar surface for receiving and supporting a substantially rectangular extended sheet. The apparatus includes a first folder for folding the substantially rectangular extended sheet along a first diagonal axis thereof to form a once folded sheet defining a long base, a second folder for folding the two halves of the base of the once folded sheet towards each other and into parallel disposition with an axis transverse to the axis of the base to form a twice folded sheet, and a third folder for folding the two halves of the twice folded sheet along a second diagonal axis thereof to form a thrice folded sheet while simultaneously removing the sheet from the substantially planar surface.

27 Claims, 5 Drawing Sheets

FIG. 1
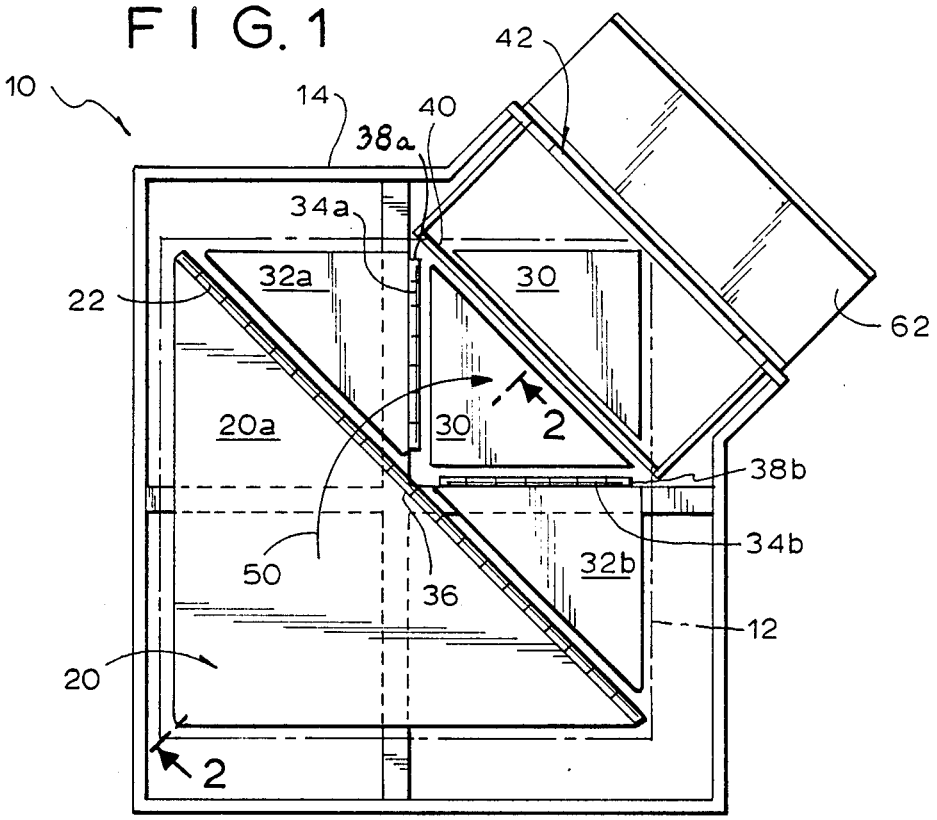
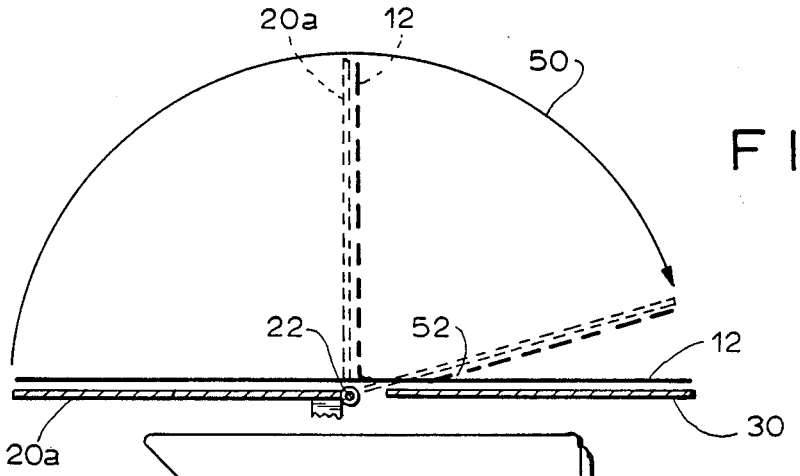
FIG. 2
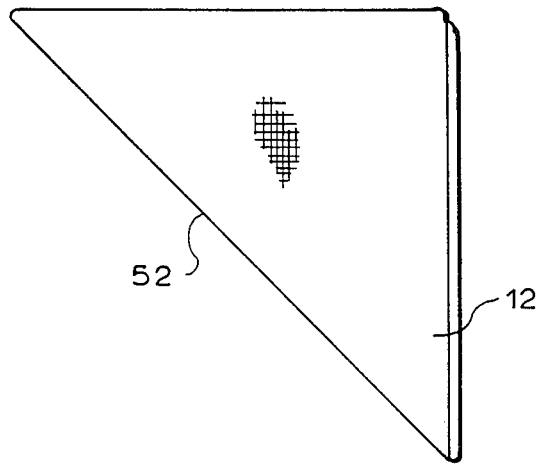
FIG. 3

FIG. 4
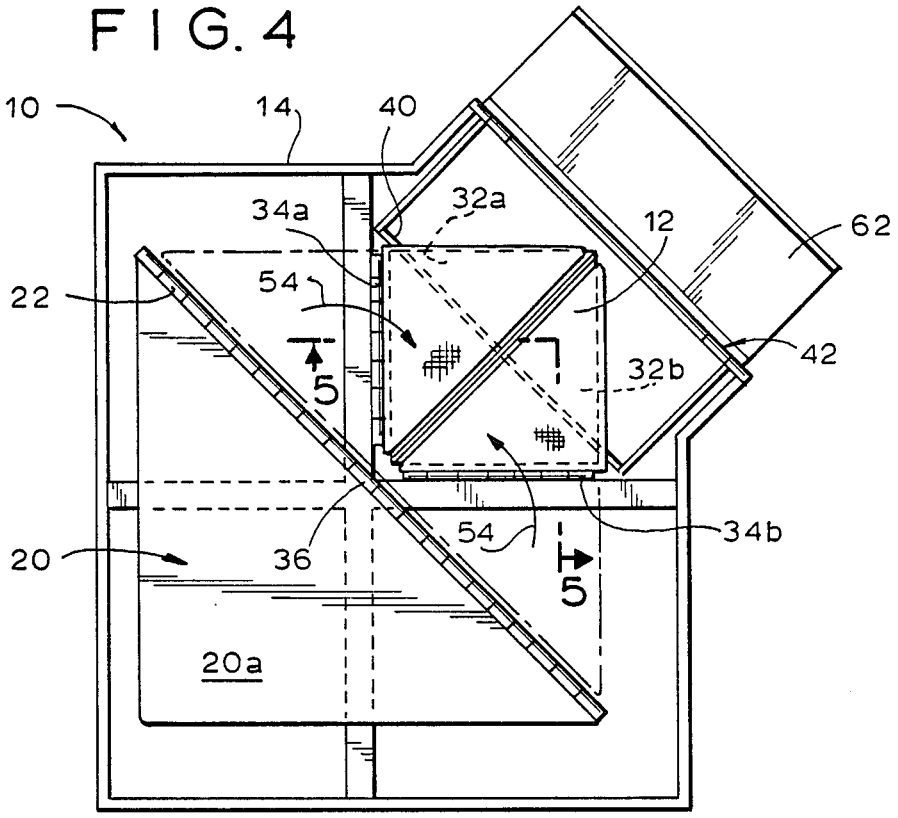
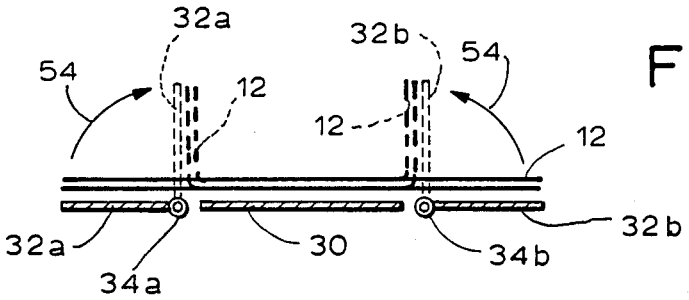
FIG. 5
FIG. 6
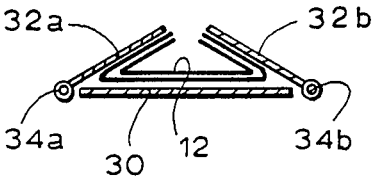
FIG. 7
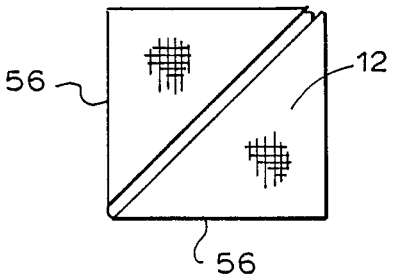

NAPKIN FOLDER

BACKGROUND OF THE INVENTION

The present invention relates to napkin folding apparatus, and more particularly to a device for rapidly and aesthetically folding a napkin.

While the folding of cloth or linen napkins for even a large-sized family can be an attention-demanding, time-consuming and aesthetically-unproductive chore, the imposing aspects of the chore cannot be truly appreciated until one considers it in the environment of a restaurant, college dining facility, or the like where the number of napkins to be folded per meal may amount to more than 1,000.

The folding of a napkin involves both aesthetic and utilitarian considerations. A neat and attractively folded napkin bodes well for the meal to come. The compaction effected by folding, especially triple folding, enables the place settings to be placed closer together without appearing crowded. Thus a napkin folding apparatus should operate rapidly to produce a multiple-folded napkin of pleasing aesthetic appearance, while being economical to manufacture and use as well as reliable and dependable in operation. The folds should not necessarily all be parallel.

While even a manually-operated napkin folding apparatus would reduce the demand for the attention and demand of an operator and produce an aesthetically attractive, well compacted folded napkin, the ultimate goal in napkin folding apparatus is, of course, a fully automated napkin folder requiring operator attention only for the inputting of extended napkins and the removal of stacked folded napkins.

Accordingly, it is an object of the present invention to provide a napkin folding apparatus for rapidly and uniformly folding napkins with multiple folds, not all necessarily parallel and optionally three or more folds.

Another object is to provide such a folder which is economical to manufacture and use and reliable and dependable in operation.

A further object is to provide such a folder which in one embodiment is fully automated and requires minimal operator attention.

SUMMARY OF THE INVENTION

It has now been found that the above and related objects of the present invention are obtained in a sheet folding apparatus generally comprising surface means for receiving and supporting an extended sheet, means for folding the extended sheet along a first axis to form a sheet with a fold therein, and means for folding the folded sheet along a second axis, non-parallel to the first axis, to form a sheet with a further fold therein while simultaneously removing the sheet from the surface. Preferably the apparatus includes means for folding the folded sheet along at least a third axis, non-parallel to the first and second axes, to form a sheet with multiple folds without removing the sheet from the surface means, whereby the removed sheet has at least three folds. At least one of the folds is a different length than another of the folds.

More particularly, the apparatus comprises a substantially planar surface for receiving and supporting a substantially rectangular extended sheet, such as a napkin. The apparatus further includes means for folding the substantially rectangular extended sheet along a first diagonal axis thereof to form a once folded sheet defining a long base, means for folding the two halves of the base of the once folded sheet towards each other and into parallel disposition with an axis transverse to the axis of the base to form a twice folded sheet, and means for folding the two halves of the twice folded sheet along a second diagonal axis thereof to form a thrice folded sheet while simultaneously removing the sheet from the substantially planar surface means.

Preferably the once and thrice folded sheets are substantially triangular in configuration and the twice folded sheet is substantially rectangular (ideally, square) in configuration. The second diagonal axis is parallel to the first diagonal axis.

In a first preferred embodiment, the folding apparatus includes a support and the means for folding along a first diagonal axis comprises a diagonal hinge means connecting one of the opposite halves of the substantially planar surface means to the support along a first diagonal axis to permit the one half to be folded over the other half and then unfolded. The means for folding the two halves of the base into parallel disposition with the transverse axis comprises a pair of shorter auxiliary hinge means extending from a common point adjacent the center point of the diagonal hinge means outwardly at substantially a right angle to one another and towards the center points of the short sides of the once folded sheets, each shorter auxiliary hinge means connecting a side portion of the other half of the substantially planar surface means to a central common portion thereof, to permit the side portion to be folded over the central common portion and then unfolded. The means for folding the two halves of the doubly folded sheet along a second diagonal axis thereof comprises a bar means movable between an inoperative position and an operative position, the bar means in the inoperative position being disposed below the level of the sheet and in the operative position being disposed substantially above the substantially planar surface means.

Preferably, the bar means is pivotably secured to the substantially planar surface means, and the substantially planar surface means defines a slot extending below the top surface thereof to receive therein the bar means as the bar means moves between the operative and inoperative positions. The bar means is L-shaped with one end thereof pivotably secured to the substantially planar surface means and the other end thereof disposed for passage through the top surface of the substantially planar surface means.

Each of the hinge means is linear (i.e., straight) and includes a pair of elements, one of the elements being adapted for pivotal movement between a first horizontal orientation substantially in the plane of the other of the elements to a second horizontal orientation above the plane of and overlapping the other element.

A second preferred embodiment of the sheet folding apparatus comprises substantially planar surface means for receiving and supporting a substantially rectangular extended sheet. The apparatus further includes means for folding the substantially rectangular extended sheet along a first diagonal axis thereof to form a substantially triangular sheet defining a long base, means for folding the two halves of the base of the substantially triangular sheet towards each other and into parallel disposition with an axis transverse to the axis of the base to form a substantially rectangular sheet, and means for folding the two halves of the substantially rectangular sheet along a second diagonal axis thereof to form a substantially triangular sheet while simultaneously removing the sheet from the substantially planar surface means.

A third preferred embodiment of the sheet folding apparatus comprises a substantially planar, substantially rectangular surface means. Diagonal hinge means connect opposite halves of the surface along a first diagonal axis, the diagonal hinge means enabling movement of one of the opposite halves between a first position in the plane of the other opposite half and a second position overlapping and in a plane above the plane of the other opposite half. A pair of auxiliary hinge means extend from a common point adjacent the center point of the diagonal hinge means outwardly at right angles to one another, each of the auxiliary hinge means connecting a different side portion of the other opposite half of the surface means to a central common portion thereof, thereby to permit movement of the side portions between a first position in the plane of said central common portion and a second position overlapping and in a plane above the plane of the central common portion. A bar means, in a pivotal relationship with the surface means, is movable between an inoperative position and an operative position, the bar means in the inoperative position being disposed no higher than the surface means and in the operative position being disposed substantially above the surface means.

BRIEF DESCRIPTION OF THE DRAWING

The above brief description, as well as other objects and features of the present invention, will be more fully understood by reference to the following detailed description of the presently preferred, albeit illustrative, embodiments of the present invention when taken in conjunction with the accompanying drawing wherein:

FIG. 1 is a top plan view of a napkin folder according to the present invention, with a napkin extended over the planar surface thereof;

FIG. 2 is a sectional view of the napkin and napkin folder making the first fold, taken along the line 2—2 of FIG. 1;

FIG. 3 is a plan view of the napkin after the first fold;

FIG. 4 is a top plan view of the napkin folder after making the second folds, the small flaps being shown in their extended position in phantom line;

FIG. 5 is a sectional view of the napkin and napkin folder before the second folds are made in solid line and with the second folds half made in phantom line, taken along the line 5—5 of FIG. 4;

FIG. 6 is a view similar to FIG. 5, but with the second folds almost completely made;

FIG. 7 is a plan view of the napkin after the second folds have been made;

DETAILED DESCRIPTION OF THE PREFERRED EMBODIMENTS

Figure 8:
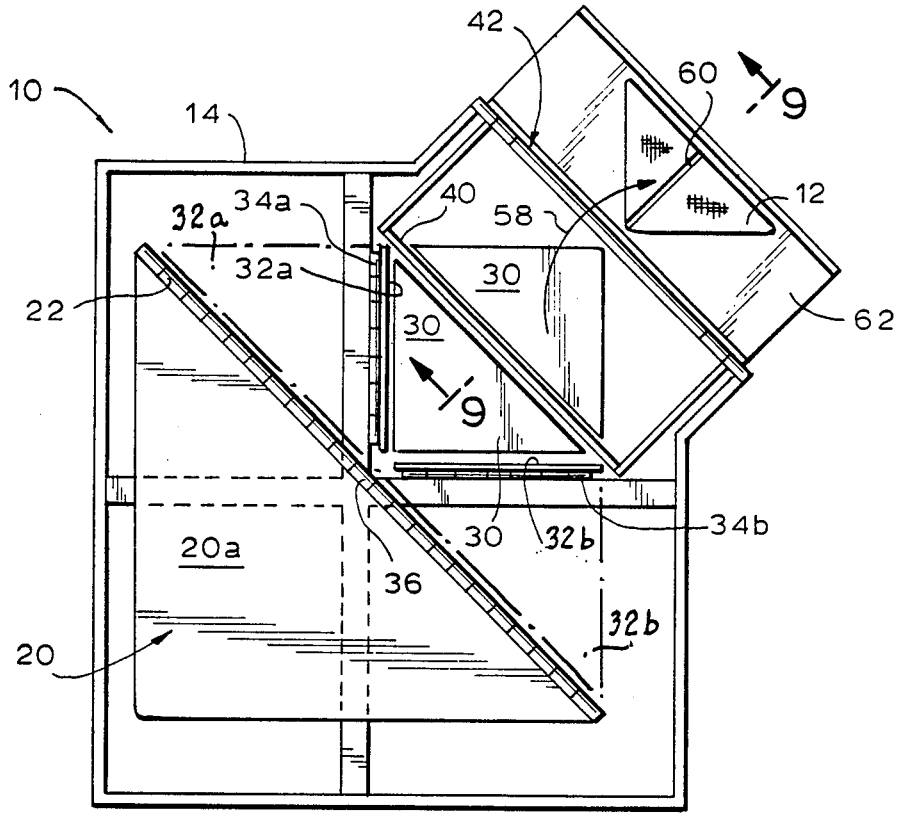
FIG. 8 is a top plan view of the napkin and napkin folder after the third fold has been made and the napkin discharged, the napkin being shown prior to the third fold in phantom line and after the third fold in solid line.

Referring now to the drawing, and in particular to FIG. 1 thereof, therein illustrated is a napkin folder according to the present invention, generally designated by the reference numeral 10. The napkin folding apparatus 10 is adapted to provide triple folds in a substantially rectangular, preferably substantially square, extended sheet 12, such as a napkin (indicated in phantom line). While generally the extended sheet would be of only a single-sheet thickness, where the sheet is formulated from material which is sufficiently flexible and extensible, the extended sheet may itself be a once or twice folded sheet having a double or quadruple sheet thickness.

The napkin folder 10 includes a support 14 which acts as a framework for supporting both the stationary and movable elements of the napkin folder 10. The support 14 is preferably substantially rectangular in horizontal outline, with a pair of cross-bars, although other configurations may be used.

A substantially planar surface 20 for receiving and supporting a substantially rectangular, preferably substantially square, extended napkin 12 within or slightly beyond its periphery constitutes the upper surface of the support 14. As will become apparent hereinafter, while an oversized napkin extending greatly beyond the periphery of the substantially planar surface 20 may still receive the first and third folds as described hereinafter, it resists a neat second fold due to the overlapping of the edges being brought together.

Referring now also to FIGS. 2–3 as well, the substantially planar surface 20 is comprised in turn of a large triangular first half surface **20*a* and a large triangular second half surface 20*b*. The two opposite triangular half surfaces 20*a*, 20*b*, lie in substantially the same plane (although not necessarily the identical plane) and are connected via a long diagonal hinge 22 extending between opposite corners of the planar surface 20, along the base of the triangular half surface 20*a***.

More particularly, the triangular half surface **20*a* is a flap pivotally connected to the support 14 by the long diagonal hinge 22. Triangular half surface 20*a* and its long diagonal hinge 22 are preferably slightly spaced apart from the opposite triangular half surface 20*b* so as to provide room for operation of the long diagonal hinge 22 without interference from the opposite half surface 20*b*. The long diagonal hinge 22 is linear (i.e., straight) and operates in the manner of a conventional hinge permitting one hinge element 20*a* to be moved between a first position wherein it is substantially in the same plane as the other hinge element 20*b*, without any substantial overlapping, and a second position wherein it overlaps the other hinge element 20*b* and is in a plane overlying the plane of the other hinge element 20*b*. Thus the long diagonal hinge 22 enables the flap 20*a* to be moved between an extended position, wherein it lies in non-overlapping relationship with the triangular half surface 20*b* and in substantially the same plane as the triangular half surface 20*b*, and a folded position, wherein it overlaps the triangular half surface 20*b* and lies in a plane above the plane of the triangular half surface 20*b*. In other words, the long triangular hinge 20 enables the surface 20** to be folded and unfolded.

As the flap **20*a* and its long diagonal hinge 22 are simply employed in making the first fold in the napkin 12 and then returned to its original position, the flap 20*a*** may be substantially rigid. On the other hand, the other triangular half surface 20b is utilized in forming the second folds of the napkin 12 and hence must be able to fold upon itself, as described hereinafter. Referring now to FIGS. 4–7 as well, the triangular half surface 20b is thus composed in turn of a common central rectangular portion 30 and two small triangular wing or side portions 32a, 32b, one side portion 32 being adjacent each of two contiguous lateral sides of the central common portion 30. A pair of short auxiliary hinges 34a, 34b (relative to long diagonal hinge 22) are secured to support 14 and extend from adjacent a center point 36 of the long diagonal hinge 22 outwardly, at substantially a right angle to each other, to the midpoints 38a, 38b of the legs of triangular half flap 20b. Thus each short auxiliary hinge 34 extends at a 45° angle to the long diagonal hinge 22. Each short auxiliary hinge 34 connects a side portion 32 directly to the support 14 and thus indirectly to the central common portion 30. If desired, however, each short auxiliary hinge 34 may connect a side portion 32 directly to the common central portion 30. Indeed, as the central common portion 30 of the flap 20b is stationary throughout the folding operation, the central common portion 30 may actually be defined in functional terms by an upward facing surface of the support 14.

In any case, the short auxiliary hinge 34a enables the side portion 32a to be folded over one half of the central common portion 30, while the short auxiliary hinge 34b enables the side portion 32b to be folded over the other half of the central common portion 30, with the side portions 32 overlapping central common portion 30 and in a common plane above the plane of the central common portion 30. The long bases of the two side portions 32a, 32b in their folded position extend parallel to one another and to an axis transverse to the long diagonal hinge 22. The short auxiliary hinges 34 further enable the side portions 32 to be unfolded and returned to their original extended position with the side portions 32 being substantially in the same plane as, and not overlapping, the central common portion 30. While higher folding rates are achieved if both side portions 32 are folded over concurrently and unfolded concurrently, if desired, one side portion 32 may be folded and unfolded before the other side portion 32 is folded and unfolded. Indeed, one side portion 32 may be initially folded, the other side portion 32 may then be folded and unfolded, and only then the first side portion finally unfolded. Each of the individual portions of the triangular half flap 20b —namely, the side portions 32a, 32b and the central common portion 30 may be substantially rigid.

Inasmuch as the two folds imparted by the side portions 32 are complementary and imparted at substantially the same time, they are considered collectively as the second fold.

Figure 9:
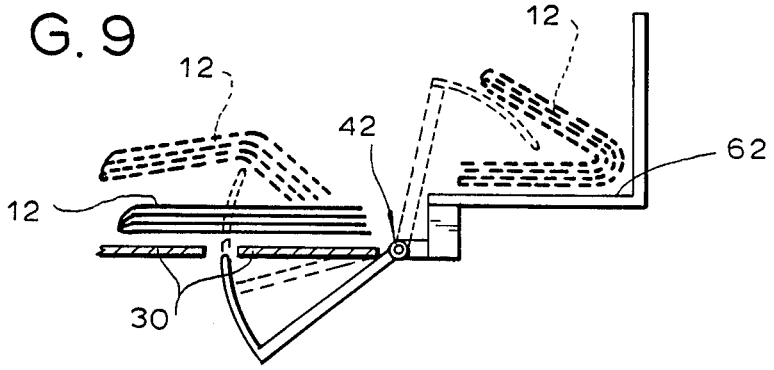
FIG. 9 is a sectional view of the napkin and napkin folder before the third fold is made in solid line, and after the third fold has been made and as the napkin is discharged in phantom line, taken along the line 9—9 of FIG. 8.
Figure 10:
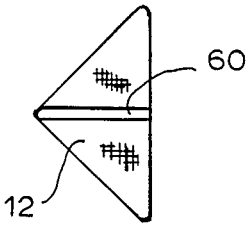
FIG. 10 is a plan view of the napkin after the third fold has been made.

Referring now to FIGS. 8–10 as well, the napkin folder 10 further includes a blade or bar 40 secured to a frame generally designated 42, the frame 42 typically being rectangular and open in the center thereof. Preferably, blade 40 extends in length from adjacent the free end 38a of the short auxiliary hinge 34a to adjacent the free end 38b of the short auxiliary hinge 34b, along an axis parallel to the long diagonal hinge 22. The blade 40 may, however, be shorter or longer, or oriented along a different axis. The blade 40 extends upwardly, preferably in an arc, towards the adjacent corner of the support 14, and may constitute one side of the frame 42. The frame 42 is pivotally secured to the support 14 to enable partial rotational movement of the frame 42, and hence the blade 40, relative to the support 14. Alternatively, the blade 40 and frame 42 may be mounted independently of the support 14, so long as the same relative pivotal movement between the blade 40 and support 14 is obtained.

The upper surface of the support 14 is slotted or cut away, as is the central common portion 30 of the half flap 20b of the substantially planar surface 20, to enable the blade 40 to move between a lowered or inoperative position wherein the top of the blade 40 is recessed below the extended napkin 12, typically below the substantially planar surface 20, to an elevated or operative position wherein the top or free end of the blade 40 is substantially above both the support 14 and the triangular half flap 20b and indeed points downwardly.

As the blade 40 moves from its inoperative lowered position to its operative elevated position, it imparts a third fold to the napkin 12 and simultaneously lifts the napkin off the planar surface 20 and deposits it into a storage area 62 for folded napkins. The blade 40 is then returned to its original position either through a reverse rotation, as illustrated, or through completion of the forward rotation.

As the manually operated napkin folder 10 has only four moving parts, it is simple and economical to construct, maintain, operate, and repair. Nonetheless, even this manual version of the napkin folder enables even unskilled labor to obtain perfectly uniform, aesthetically appealing, multiple-folded napkins at very high rates.

To facilitate movement of the large triangular half flap 20a or the smaller triangular side portions 32, or the frame 42, from their original positions to their rotated or folded positions and back again to their original positions, tabs, finger grips or other extensions of these elements may be provided to facilitate grasping by the hand, finger or the like for movement.

To operate the napkin folder, a napkin 12 is extended over the substantially planar rectangular surface 20, as shown in FIG. 1. The triangular half flap 20a is then raised upwardly about long hinge 22 (through the positions shown in phantom line) and finally downwardly toward the other triangular half flap 20b, in the direction of arrow 50, as illustrated in FIG. 2. The triangular half flap 20a is finally reverse rotated, back to its original extended position, leaving a triangular napkin 12 having a single fold 52 relative to the original square napkin 12, as illustrated in FIG. 3.

Next, the two wings or side portions 32 are rotated about the short auxiliary hinges 34, in the direction of arrows 54, from the solid line position of FIG. 5 and the phanton line position of FIG. 4, through the intermediate positions shown in phantom line in FIG. 5 and solid line in FIG. 6 to the final position shown in solid line in FIG. 4. (FIG. 5 illustrates the side portions 32 in phantom line in a vertical position, midway through the process of being rotated about their hinges 34.) When the side portions 32 have been fully rotated, as shown in FIG. 4, the napkin 12 has two additional side folds 56 disposed at right angles to each other. Thereafter, the side portions 32 are reverse rotated, back to their original extended positions, leaving the square napkin 12, as illustrated in FIG. 7 twice folded (albeit with three folds).

Finally, the frame 42 is rotated relative to the support 14 to cause the top or free end of blade 40 to pivot at least from the horizontal through the vertical, and preferably substantially therebeyond, as illustrated in FIGS.

8 and 9. As the blade 40 leaves the plane of the substantially planar surface 20, it imposes a third fold 60 on the napkin 12 and eventually causes the napkin 12 to be lifted off of the substantially planar surface 20 and preferably away from the support 14, as shown in phantom line in FIG. 9. The thrice folded napkin, as illustrated in FIG. 10, is dropped by the blade 40 in a storage area 62, ready to be placed on a table. The frame 42 is then reverse rotated to its original position with the blade 40 disposed beneath the substantially planar surface 20. The substantially planar surface 20 is then ready to receive another extended napkin 14 for folding.

While the napkin folder apparatus illustrated and described above facilities the manual folding of napkins and other sheets, it does not provide fully automated folding. However, the apparatus illustrated and described is easily amenable to full mechanization to provide automatic folding. Thus means may be provided for rotating the triangular half flap 20*a* about the long diagonal hinge 22 until it is overlying and overlapping the triangular half flap 20*b* and thereafter returning the triangular half flap 20*a* to its original extended position. Similarly, means may be provided for pivoting each of the side portions 32 about their respective short auxiliary hinges 34 until they overlie and overlap the common central portion 30, and thereafter returning the side portions 32 to their original extended positions. Finally, means may be provided to pivot the blade-carrying frame 42 from its original inoperative position below the level of the support 14 through an arc (generally an angle of at least 90°) sufficient to fold and discharge the napkin 12.

Separate drive means may be provided for each of the mechanized operations (that is, rotation about the long diagonal hinge 22, rotation about the short auxiliary hinges 34 and rotation of the frame 42), or a common drive means may be utilized with auxiliary cams, drive belts, or gears, as necessary. The drive means may be mechanical (e.g., by camming), pneumatic, hydraulic or the like, depending upon the available sources of power, cost factors, and the like.

Figure 11:
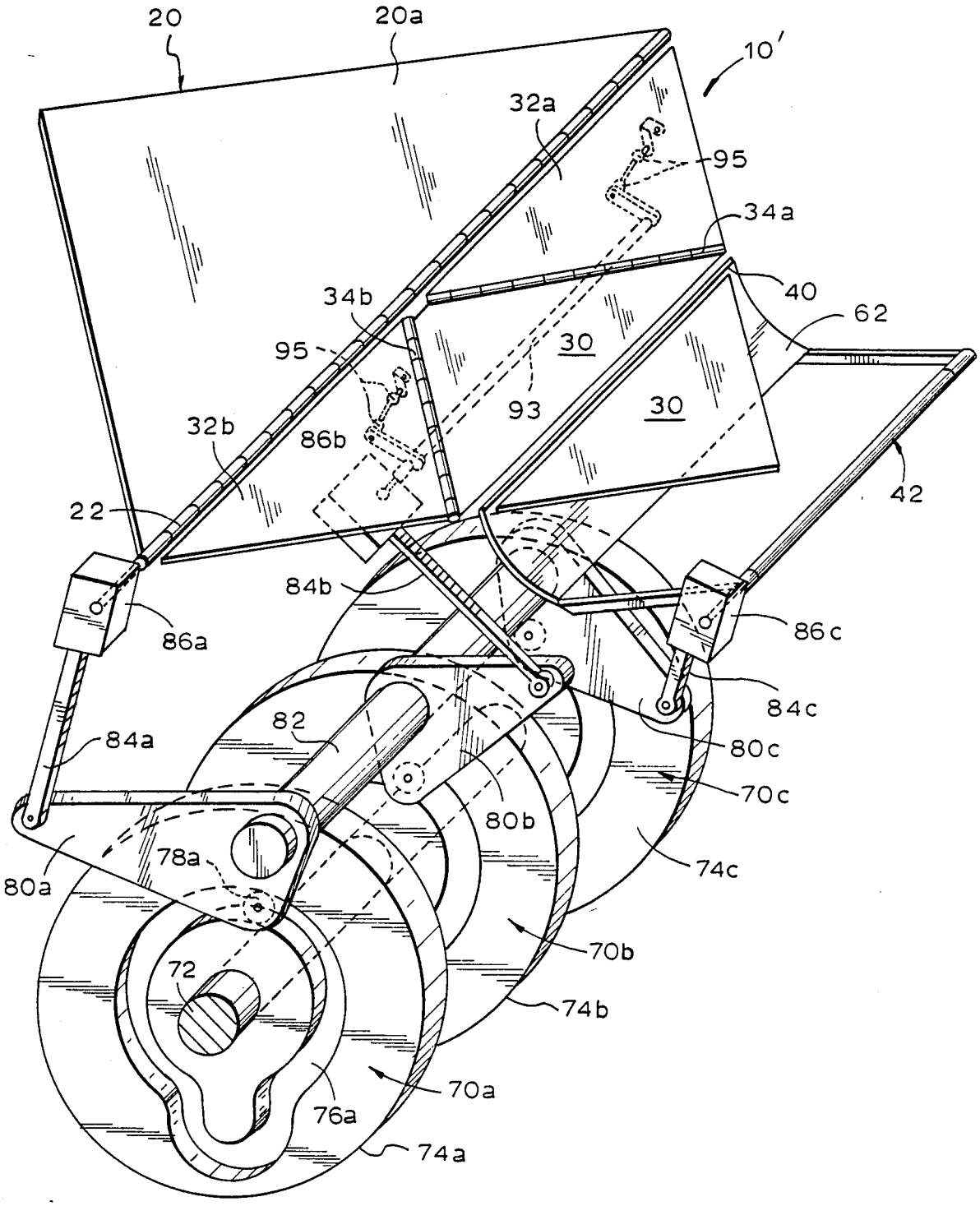
FIG. 11 is an isometric view of an automated napkin folder according to the present invention.
Figure 12:
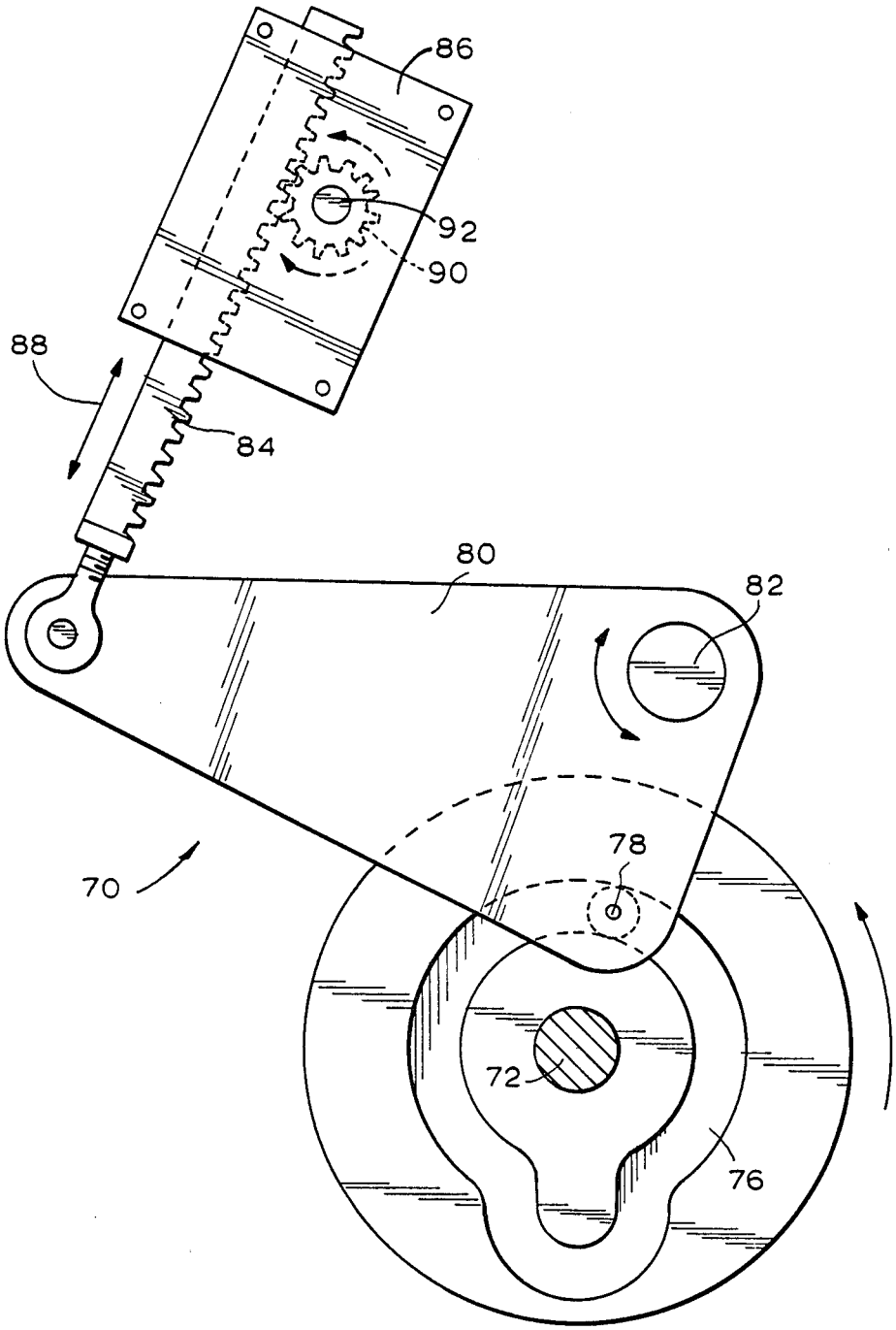
FIG. 12 is a side elevation view, to an enlarged scale, of a cam system of the automated napkin folder.

Referring now to FIG. 11, therein illustrated is one embodiment of a fully automated napkin folder 10'. Elements of the napkin folder 10' performing the same functions as the elements of the napkin folder 10 are correspondingly numbered. In addition to the elements of napkin folder 10, napkin folder 10' includes a plurality of cam systems, generally designated 70, driven by a common drive or cam shaft 72. Each cam system 70, as best illustrated in FIG. 12, includes a cam 74, driven by the common cam shaft 72 and defining an internal cam groove 76, a cam follower 78 with internal ball bearings to facilitate friction-free movement along the cam groove 76, a cam follower arm 80 pivotally mounted on a common pivot shaft 82, secured to the cam follower 78 for movement therewith, and reciprocatingly driving the rack 84 of a rack and pinion gearbox 86 (as indicated by double headed arrow 88). The pinion 90 of the rack and pinion gearbox 86 is connected to the a drive means or shaft 92 of an operating element 22, 32, 42 of the napkin folder to drive the element as heretofore described.

Referring now to FIG. 11, a first cam system 70*a*—comprising a common drive shaft 72, a cam 74*a*, a cam follower 78*a*, a cam follower arm 80*a*, and a rack and pinion gearbox 86*a* —controls operation of the long diagonal hinge 22 and thus triangular half flap 20*a*. A second system 70*b* controls rotation of a shaft 93 secured to each of the small triangular portions 32 by two ball and socket linkages 95 enabling multiple degrees of freedom of movement so that the side portion 32 can be rotated about the short auxiliary hinges 34. A third cam system 70*c* controls operation of the blade-carrying frame 42. The cams 74 are so oriented about the cam shaft 72 and the internal cam grooves 76 are so configured that each moving element 22, 34, 42 of the napkin folder 10' is pivoted or rotated and then reverse pivoted or rotated at the appropriate time, for the appropriate duration, and to the appropriate extent. Fine tuning of the drive system to achieve the desired results is well within the competence of one skilled in the mechanical arts and requires no undue experimentation.

It will be appreciated that in the automated napkin folder 10' the napkin folding operation cannot be commenced until the napkin 12 has been extended over the substantially planar surface 20. Indeed, for safety sake, a sensor should be disposed so as to detect the presence of the operator's hands within any dangerous area of the folder and to disable operation of the folder until the hands have been removed. The precise design of such a safety mechanism is within the competence of those skilled in the art of safety mechanisms for industrial apparatus. To obviate this danger, and to further enhance the effective rate of the apparatus by permitting an overlap of the extending operation and the folding operation, a feed or staging area (not shown) may be provided away from the moving elements: flap 20*a*, side portions 32 and frame 42. The napkin 12 may be extended safely over a substantially planar surface in the staging area and then transported from the staging area onto the substantially planar surface 20. Then, as this napkin is being folded, the next napkin to be folded may be extended on the substantially planar surface of the staging area. Such feed mechanisms are well known in the mechanical arts and hence need not be described in further detail herein.

To summarize, the present invention provides a napkin folding apparatus for rapidly and uniformly folding napkins with multiple folds which need not necessarily all be parallel and which may optionally be three or more folds. The folder is economical to manufacture and use and reliable and dependable in operation. The folder may be fully automated so as to require minimal operator attention.

Now that the preferred embodiments of the present invention has been shown and described in detail, various modifications and improvements thereon will become readily apparent to those skilled in the art. Accordingly, the appended claims should be construed broadly in a manner consistent with the spirit and scope of the invention herein.

I claim:

1. A sheet folding apparatus comprising:

(A) surface means for receiving and supporting an extended sheet;

(B) means for folding the extended sheet along a first axis to form a sheet with a fold therein;

(C) means for folding portions of the folded sheet along a spaced pair of second axes to form a sheet with multiple folds; and (D) means for folding portions of the multiple folded sheet along a third axis, said first and third axes being parallel, said second axes being non-parallel to said first and third axes, to form a sheet with a further fold therein.

2. The apparatus of claim 1 wherein at least one of said folds is of different length than another of said folds.

3. The apparatus of claim 1 wherein said means for folding portions of the multiple folded sheet along a third axis also simultaneously removes the sheet from said surface means.

4. The apparatus of claim 1 wherein each of said various folding means moves from a first position to a second position to make a fold and returns from the second position to the first position after the fold is made and before the next folding operation on the sheet.

5. The apparatus of claim 1 wherein each of said folding means folds the sheet without movement of the sheet beyond the folding and the removal thereof from said surface means.

6. The apparatus of claim 1 wherein said first axis is a substantially diagonal axis of the extended sheet.

7. A sheet folding apparatus comprising:

(A) substantially planar surface means for receiving and supporting an extended sheet of substantially rectangular configuration, said substantially planar surface means having two opposite halves;

(B) means for folding the substantially rectangular extended sheet along a first diagonal axis thereof to form a once folded sheet defining a long base and having two halves;

(C) means for folding the two halves of the once folded sheet towards each other and into parallel disposition with an axis transverse to the axis of the base to form a twice folded sheet; and (D) means for folding the two halves of the twice folded sheet along a second diagonal axis thereof to form a thrice folded sheet while simultaneously removing the sheet from said substantially planar surface means.

8. The sheet folding apparatus of claim 7 wherein said once and thrice folded sheets are substantially triangular in configuration and said twice folded sheet is substantially rectangular in configuration.

9. The sheet folding apparatus of claim 8 wherein said substantially rectangular configurations of said extended sheet and said twice folded sheet are substantially square configurations.

10. The sheet folding apparatus of claim 7 wherein said second diagonal axis is parallel to said first diagonal axis.

11. The sheet folding apparatus of claim 7 wherein said means for folding along a first diagonal axis comprises a diagonal hinge means dividing said substantially planar surface means into said two opposite halves and being connected to the one of said opposite halves of said substantially planar surface means along a first diagonal axis, adjacent to the other of said opposite halves, to enable said substantially planar surface means to be folded once and then unfolded.

12. The sheet folding apparatus of claim 11 wherein said means for folding the two halves of the base into parallel disposition with said transverse axis comprise a pair of auxiliary hinge means extending from a common point adjacent the center point of said diagonal hinge means outwardly at a substantially right angle to one another, each auxiliary hinge means being connected to an opposite side portion of said other opposite half of said substantially planar surface means, adjacent a central common portion thereof, to permit said side portion to be folded over said central common portion and then unfolded.

13. The sheet folding apparatus of claim 11 wherein said means for folding the two halves of the base into parallel disposition with said transverse axis comprises a pair of shorter hinge means extending outwardly from a common point adjacent the center point of said diagonal hinge means towards the center points of the shorter sides of the once folded sheet, each shorter hinge means being connected to an opposite side portion of said other opposite half of said substantially planar surface means, adjacent a central common portion thereof, to permit said side portion to be folded over said central common portion and then unfolded.

14. The sheet folding apparatus of claim 12 wherein said means for folding the two halves of said doubly folded sheet along a second diagonal axis thereof comprises a bar means movable between an inoperative position and an operative position, said bar means in said inoperative position being disposed below the level of the sheet and in said operative position being disposed substantially above said substantially planar surface means.

15. The sheet folding apparatus of claim 13 wherein said means for folding the two halves of said doubly folded sheet along a second diagonal axis thereof comprises a bar means movable between an inoperative position and an operative position, said bar means in said inoperative position being disposed below the level of the sheet and in said operative position being disposed substantially above said substantially planar surface means.

16. The sheet folding apparatus of claim 7 additionally including a support disposed beneath said substantially planar surface; and wherein said means for folding along a first diagonal axis comprises a diagonal hinge means connecting one of said opposite halves of said substantially planar surface means to said support along the first diagonal axis to permit said one half to be folded over the other half;

said means for folding the two halves of the base into parallel disposition with said transverse axis comprise a pair of shorter auxiliary hinge means extending from a common point adjacent the center point of said diagonal hinge means outwardly at substantially a right angle to one another and towards the center points of the short sides of the once folded sheets, each said shorter auxiliary hinge means connecting a side portion of the other half of the substantially planar surface means to a central common portion thereof, to permit said side portion to be folded over said central common portion; and said means for folding the two halves of said doubly folded sheet along a second diagonal axis thereof comprises a bar means movable between an inoperative position and an operative position, said bar means in said inoperative position being disposed below the level of the sheet and in said operative position being disposed substantially above said substantially planar surface means.

17. The sheet folding apparatus of claim 16 wherein said bar means is pivotably secured to said substantially planar surface means, and said substantially planar surface means defines a slot extending below the top surface thereof to receive therein said bar means in said inoperative position.

18. The sheet folding apparatus of claim 16 wherein said bar means is L-shaped in cross section with one end thereof pivotably secured to said substantially planar surface means and the other end thereof disposed for passage through the top surface of said substantially planar surface means.

19. The sheet folding apparatus of claim 7 configured and dimensioned for use with a napkin as the sheet.

20. The sheet folding apparatus of claim 12 wherein each of said hinge means is linear and includes a pair of elements, one of said elements being adapted for pivotal movement between a first horizontal orientation substantially in the plane of the other of said elements upwardly to a second horizontal orientation above the plane of said other element.

21. A napkin folding apparatus comprising:

(A) substantially planar surface means for receiving and supporting a substantially square extended napkin sheet, said substantially planar surface means having two opposite halves;

(B) means for folding the substantially square extended sheet along a first diagonal axis thereof to form a substantially triangular once folded sheet defining a long base having two halves;

(C) means for folding the two halves of the base of the once folded sheet towards each other and into parallel disposition with an axis transverse to the axis of the base to form a substantially square twice folded sheet; and (D) means for folding the two halves of the twice folded sheet along a second diagonal axis thereof, parallel to said first diagonal axis, to form a substantially triangular sheet while simultaneously removing the sheet from said substantially planar surface means.

22. The napkin folding apparatus of claim 21 additionally including a support beneath said substantially planar surface means; and wherein said means for folding along a first diagonal axis comprises a diagonal hinge means connecting one of said opposite halves of said substantially planar surface means to said support along a first diagonal axis to permit said one half to be folded over the other half;

said means for folding the two halves of the base into parallel disposition with said transverse axis comprise a pair of shorter auxiliary hinge means extending from a common point adjacent the center point of said diagonal hinge means outwardly at substantially a right angle to one another and towards the center points of the short sides of the once folded sheets, each shorter auxiliary hinge means connecting a side portion of the other half of the substantially planar surface means to a central common portion thereof, to permit said side portion to be folded over said central common portion; and said means for folding the two halves of said doubly folded sheet along a second diagonal axis thereof comprises a bar means movable between an inoperative position and an operative position, said bar means in said inoperative position being disposed below the level of the sheet and in said operative position being disposed substantially above said substantially planar surface means.

23. The napkin folding apparatus of claim 22 wherein said substantially planar surface means defines a slot extending below the top surface thereof to receive therein said bar means in said inoperative position, and said bar means is L-shaped in cross section with one end thereof pivotably secured to said substantially planar surface means and the other end thereof disposed for passage through the top surface of said substantially planar surface means.

24. A sheet folding apparatus comprising:

(A) a substantially planar, substantially rectangular surface means;

(B) diagonal hinge means connecting opposite halves of said surface along a first diagonal axis, said diagonal hinge means enabling movement of one of said opposite halves between a first position in the plane of the other of said opposite halves and a second position overlapping and in a plane above said plane of said other half;

(C) a pair of auxiliary hinge means extending from a common point adjacent the center point of said diagonal hinge means outwardly at right angles to one another, each of said auxiliary hinge means connecting a different side portion of the other half of said surface means to a central common portion thereof to permit movement of said side portions between a first position in the plane of said central common portion and a second position overlapping and in a plane above said plane of said central common portion; and (D) bar means in a pivotal relationship with said surface means and movable between an inoperative position and an operative position, said bar means in said inoperative position being disposed no higher than the level of said surface means and in said operative position being disposed substantially above said surface means.

25. The apparatus of claim 24 wherein said surface means defines a slot therethrough for passage of said bar means during movement between said operative and inoperative positions.

26. The sheet folding apparatus of claim 24 wherein said hinge means are linear and include a pair of elements, one of said elements being adapted for pivotal movement between a first horizontal orientation in the plane of the other of said elements and a second horizontal orientation above the plane of said other element.

27. The sheet folding apparatus of claim 24 wherein said bar means is L-shaped in cross section with one end thereof pivotably secured to said substantially planar surface means and the other end thereof disposed for passage through the top surface of said substantially planar surface means.

* * * * *